US006791251B2

(12) United States Patent
Seo et al.

(10) Patent No.: US 6,791,251 B2
(45) Date of Patent: Sep. 14, 2004

(54) METAL CATHODE AND INDIRECTLY HEATED CATHODE ASSEMBLY HAVING THE SAME

(75) Inventors: Dong-Kyun Seo, Suwon (KR); Jong-Seo Choi, Anyang (KR); Kyoung-Cheon Son, Suwon (KR); Kyu-Nam Joo, Seoul (KR); Sung-Hwan Moon, Suwon (KR); Yoon-Chang Kim, Suwon (KR); Seung-Kwon Han, Seoul (KR); Bu-Chul Sin, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 72 days.

(21) Appl. No.: 10/077,762

(22) Filed: Feb. 20, 2002

(65) Prior Publication Data

US 2002/0153819 A1 Oct. 24, 2002

(30) Foreign Application Priority Data

Feb. 21, 2001 (KR) ..... 2001-8753

(51) Int. Cl.[7] ..... H01J 1/20; H01J 19/14

(52) U.S. Cl. ..... 313/337; 313/310; 313/311; 313/346 R; 313/346 DC

(58) Field of Search ..... 313/310, 311, 313/337, 346 R, 346 DC, 355, 292; 445/49

(56) References Cited

U.S. PATENT DOCUMENTS 4,137,476 A 1/1979 Ishii et al.
4,260,665 A * 4/1981 Aida et al. ..... 313/346 R
4,533,852 A * 8/1985 Frank et al. ..... 313/355
5,118,984 A * 6/1992 Saito et al. ..... 313/346 R
5,334,085 A * 8/1994 Shroff ..... 313/346 DC

FOREIGN PATENT DOCUMENTS

SU 1975520 10/1975

OTHER PUBLICATIONS

"Osmium Dispenser Cathodes" by P. Zalm and A.J.A. van Stratum, in *Phillips Technical Review*, vol. 27, 1966, No. 3/4.

* cited by examiner

*Primary Examiner*—Ashok Patel
*Assistant Examiner*—Mariceli Santiago
(74) *Attorney, Agent, or Firm*—Robert E. Bushnell, Esq.

(57) ABSTRACT

A metal cathode for an electron-emission device, and an indirectly heated cathode assembly employing the metal cathode where the metal cathode is formed of a quaternary alloy including 0.1–20% by weight barium (Ba), 0.1–20% by weight a metallic mobilizer facilitating Ba diffusion, a metal with a difference in atomic radius of at least 0.4 Angstrom from the atomic radius of platinum (Pt) or palladium (Pd), the metal being in the range of 0.01 to 30% by weight, and a balance of at least one of Pt and Pd. The metal cathode has a low operating temperature due to its reduced work function with improved current emission capability. The metal cathode can be used for a longer lifetime at high current density. Therefore, the metal cathode can be used effectively in electron-beam devices, such as a Braun tube or picture tube, satisfying larger size, longer life span, high definition, and high luminance requirements of the devices.

19 Claims, 5 Drawing Sheets

METAL CATHODE AND INDIRECTLY HEATED CATHODE ASSEMBLY HAVING THE SAME

CLAIM OF PRIORITY

This application makes reference to, incorporates the same herein, and claims all benefits accruing under 35 U.S.C. § 119 from my application METAL CATHODE AND INDIRECTLY HEATED CATHODE ASSEMBLY HAVING THE SAME filed with the Korean Industrial Property Office on Feb. 21, 2001 and there duly assigned Ser. No. 8753/2001.

BACKGROUND OF THE INVENTION

1. Technical Field

The present invention relates to a metal cathode used in electron-beam devices, and more particularly, to a thermoelectron-emissive metal cathode and an indirectly heated cathode assembly employing the thermoelectron-emissive metal cathode that can be applied to electron-beam devices.

2. Description of the Background Art

As a conventional cathode used in an electron tube, oxide cathodes have been widely used. An oxide cathode includes an electron emissive material layer on a metal base containing nickel (Ni) as a main component and a trace reducing agent such as silicon (Si) or magnesium (Mg). The electron emissive material layer is formed of a carbonate oxide of alkaline earth metals containing barium (Ba) as a main component, but preferably, an oxide of a ternary carbonate of (Ba, Sr, Ca)$CO_3$ or a binary carbonate of (Ba, Sr)$CO_3$. Such oxide cathodes are operable at a relatively low temperature of 700–800° C. (Celsius) due to their low work function, but have a limited electron emission capability with a current density less than 1 A/cm$^2$ (Amperes per centimeter square). Furthermore, since the oxide cathode is formed of a semiconductor and has high electrical resistance, degradation of the cathode is resulted from evaporation or melting of the material caused by self-heating by Joule heat as the current density is increased. Also, an intermediate resistance layer is formed between the metal base and the oxide layer with increased use, thereby shortening the life span of the cathode.

The oxide cathode is fragile and has weak adhesion to the metal base. Thus, adopting this type of cathode can reduce the life of a cathode-ray tube (CRT). As an example, a costly color picture tube that needs three oxide cathodes may fail entirely if only one of the oxide cathodes is damaged.

For this reason, approaches to using a high-performance metal cathode, which is free from the drawback of the oxide cathode, in a CRT are increasing. In addition, in order to keep in step with the recent need for a Braun tube with a larger-sized screen, longer lifetime, high-definition, and high-luminance, there is a need for a cathode having a longer lifetime at high current density.

For example, a lanthanum hexaboride ($LaB_6$) based metal cathode, which has been developed to meet the above requirement, is more durable and has greater electron emission capability than oxide cathodes. The monocrystaline cathode of lanthanum hexaboride has a high current density of about 10 A/cm$^2$. However, the short life span of the lanthanum hexaboride based metal cathode limits its application to only a vacuum electron device with a replaceable cathode unit. The short life span of the lanthanum hexaboride based metal cathode is due to a high reactivity to the constituent material of a heater. Lanthanum hexaboride changes into a weakly bound compound by contact with tungsten, which is common as a material of a heater.

U.S. Pat. No. 4,137,476 issued to Ishii et al. for Thermionic Cathode, discloses a cathode with a barrier layer between a lanthanum hexaboride cathode and the body of a heater for blocking possible reaction between the cathode and the heater. However, the cathode has a considerably high manufacturing cost and a poor life extension effect. Research into and development of a cathode based on secondary electron emission and an impregnated cathode are being conducted, but they still have the problems of short lifetime and high production cost.

The conventional metal cathode causes many problems during operation due to its high operating temperature, such as a current leakage between the heater and cathode or a heater disconnection. USSR Patent No. 1975520 issued to Petrovich et al. for Cathode of Electronic Device, discloses a method of adding an alkali metal in forming a cathode of a metal alloy having a platinum group metal and alkaline earth metal so as to lower the operating temperature and increase a secondary emission coefficient. USSR Patent No. 1975520 discloses in particular cathodes that are made of alloys of Ni—Mg—Li, Ni—Sr—Li, or Ni—Ca—Li. The working temperatures of cathodes made specifically of alloys of Ni—Mg—Li, Ni—Sr—Li, or Ni—Ca—Li were lowered, however, the problem of the high working temperature of cathodes made of alloys of Pt—Ba or Pd—Ba were in reality not solved. The cathodes made of alloys of Pt—Ba or Pd—Ba still had high operating temperatures of up to 1200° C. (Celsius), thereby causing a problem of heater disconnection and current leakage when applied to a Braun tube, as described above.

Furthermore, the manufacture of a conventional CRT involves an aging process at a higher temperature, i.e., about 1300° C. (Celsius), than the operating temperature of cathodes, i.e., 1100–1200° C. (Celsius) to warm up the cathodes. Such an aging process creates a serious risk of damage such as current leakage and heater disconnection.

Although metal cathodes such as those described above can be used in a CRT, thermal distortion of neighboring electrodes, particularly, the G1 electrode, caused by a metal cathode working at a high temperature results in increased stabilization time, thereby limiting practical uses.

SUMMARY OF THE INVENTION

It is therefore an object of the present invention to provide a thermoelectron-emissive metal cathode for electron-beam devices such as a Braun tube and picture tube, with a low operating temperature, good electron emission capability, and an extended life span at high current density.

It is another object of the present invention to provide an indirectly heated cathode assembly employing the above thermoelectron-emissive metal cathode.

To achieve the above and other objects of the present invention, there is provided a metal cathode for an electron-beam device, the metal cathode including an electron-emitter formed of a quaternary alloy including 0.1–20% by weight barium (Ba), 0.1–20% by weight a metallic mobilizer facilitating Ba diffusion, 0.01–30% by weight a metal with a difference in atomic radius of at least 0.4 Å (Angstrom) from the atomic radius of platinum (Pt) or palladium (Pd), and a balance of at least one of Pt and Pd.

In the metal cathode according to the present invention, it is preferable that the metallic mobilizer facilitating Ba diffusion is at least one member selected from the group including molybdenum (Mo), hafnium (Hf), zirconium (Zr), and thorium (Th).

In the metal cathode according to the present invention, it is preferable that the metal with a difference in atomic radius of at least 0.4 Å(Angstrom) from the atomic radius of platinum (Pt) or palladium (Pd) is at least one member selected from the group including calcium (Ca), strontium (Sr), and cerium (Ce). It is also preferable that the metal with a difference in atomic radius of at least 0.4 Å (Angstrom) from the atomic radius of platinum (Pt) or palladium (Pd) is an alloy of cerium (Ce) and iridium (Ir). The alloy of cerium and iridium is preferably $Ir_5Ce$.

There is also provided a metal cathode for an electron-beam device, the metal cathode including an electron-emitter formed of a quaternary alloy including 0.1–20% by weight barium (Ba), 0.1–20% by weight a metallic mobilizer facilitating Ba diffusion, 0.01–30% by weight a metal with a difference in atomic radius of at least 0.4 Å (Angstrom) from the atomic radius of platinum (Pt) or palladium (Pd), and a balance of at least one of Pt and Pd, and a layer of a material having a larger work function than above quaternary alloy coated on the electron-emitter. It is preferable that the material having a larger work function than the quaternary alloy is one of iridium (Ir) and an alloy of osmium (Os) and ruthenium (Ru). It is preferable that the coated layer has a thickness of 500–30,000 Å (Angstrom). It is preferable that the alloy of Os and Ru contains 1–10% by weight Ru.

In the metal cathode according to the present invention, it is preferable that the metallic mobilizer facilitating Ba diffusion is at least one selected from the group including molybdenum (Mo), hafnium (Hf), zirconium (Zr), and thorium (Th).

In the metal cathode according to the present invention, it is preferable that the metal with a difference in atomic radius of at least 0.4 Å (Angstrom) from the atomic radius of platinum (Pt) or palladium (Pd) is at least one selected from the group including calcium (Ca), strontium (Sr), and cerium (Ce). It is also preferable that the metal with a difference in atomic radius of at least 0.4 Å (Angstrom) from the atomic radius of platinum (Pt) or palladium (Pd) is an alloy of cerium (Ce) and iridium (Ir), and more preferably $Ir_5Ce$.

An indirectly heated cathode assembly employing the metal cathode described above is also preferable.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Turning now to the drawings, a metal cathode and a method of manufacturing the metal cathode according to the present invention will be described in greater detail. The present invention is characterized in that an electron-emitter of the metal cathode is formed of a quaternary alloy to reduce the operating temperature to be lower than a metal cathode formed of a binary alloy of a platinum (Pt) group metal and alkaline earth metal. The electron-emitter of the metal cathode according to the present invention is formed by the addition of a metallic mobilizer facilitating barium (Ba) diffusion into the binary alloy and a metal with a different atomic diameter from platinum (Pt) or palladium (Pd) capable of changing the atomic and electronic structure of the binary alloy.

Figure 1A:
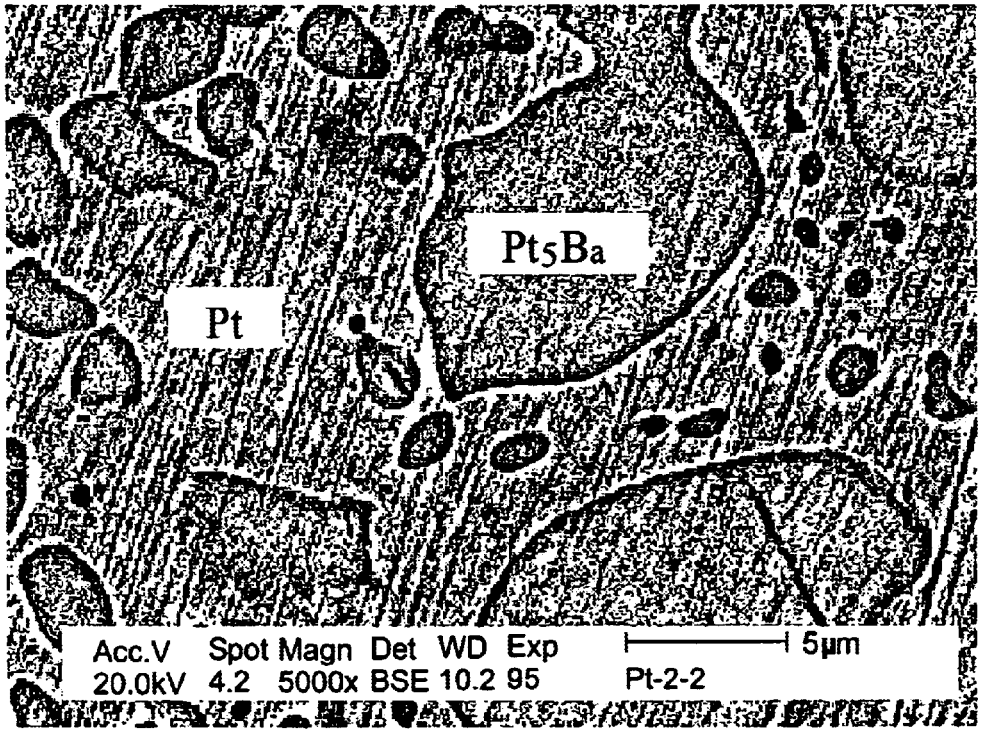
FIG. 1A is a photo showing dissolution of $Pt_5Ba$ in a conventional metal cathode.
Figure 1B:
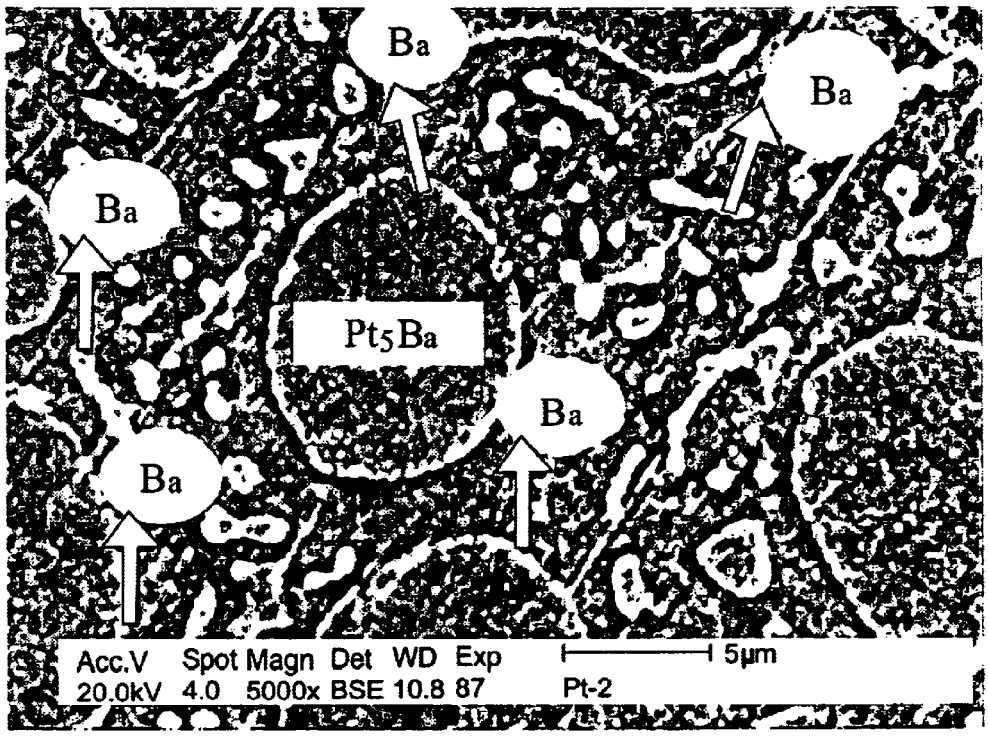
FIG. 1B is a photo showing Ba diffusion in the emitter of the conventional metal cathode.
Figure 1C:
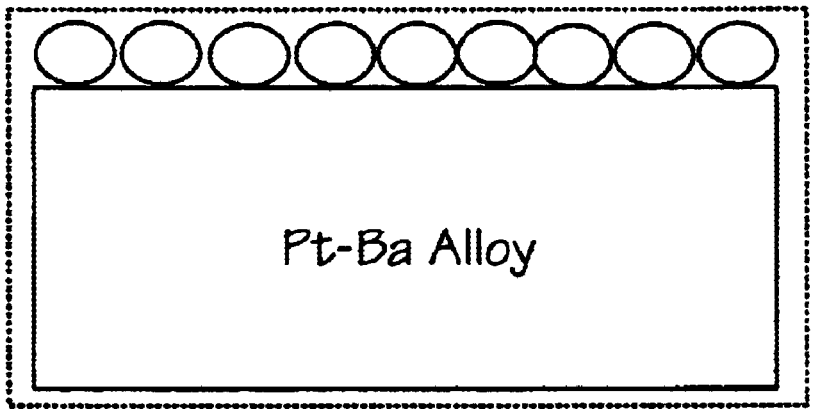
FIG. 1C is a sectional view showing a Ba monoatomic layer on the surface of the emitter of the conventional metal cathode.

FIGS. 1A, 1B, and 1C show each step of the electron emission mechanism in a conventional Pt—Ba alloy based cathode.

A metal cathode formed of pure Pt has a work function as large as 5.3 eV, but the work function is reduced to 2.2 eV by addition of Ba, thereby enabling the metal cathode to serve as a thermoelectron-emissive cathode. Reduction in work function by the addition of Ba is explained as being due to a reduction in surface work function by formation of Ba monoatomic layer on the surface of the Pt—Ba alloy cathode during operation.

Accordingly, an electron emission mechanism of the Pt—Ba alloy cathode involves the following three steps. The first step is decomposition of $Pt_5Ba$ of the alloy, as shown in FIG. 1A. In a Pt—Ba alloy containing Ba less than 16.66% by weight, Ba exists in the form of $Pt_5Ba$ as an intermetallic compound, which is decomposed during cathode operation to provide Ba atoms. The second step is diffusion of decomposed Ba atoms toward the emitter surface, as shown in FIG. 1B. Such Ba diffusion should be fast and continuous to give improved characteristics and increase the life span of the cathode. The third step is optimal formation of a Ba monoatomic layer on the surface of the emitter. Through these three steps, the work function at the emitter surface is reduced, thereby enabling electron emission at a relatively low temperature.

However, as described above, the thermoelectron-emissive cathode formed of a binary alloy of Pt and Ba has better electron emission characteristics than a conventional oxide cathode, but has a high operating temperature of about 1200° C. (Celsius), thereby causing a heater disconnection and current leakage to occur. Also, the binary alloy based thermelectron-emissive cathode has a limited life span due to excess crystal growth in the emitter.

To address the above limitations, a method for lowering the work function of the cathode based on the electron emission mechanism described above has been studied. As a result, there has been success in manufacturing a thermoelectron-emissive cathode with a reduced work function, low operating temperature, good electron emission capability, and extended life span at high current density, by forming the electron-emitter of the cathode using a quaternary alloy. The quaternary alloy is obtained by adding to a binary alloy containing a Pt group metal and alkaline earth metal, a mobilizer such as molybdenum (Mo), hafnium (Hf), zirconium (Zr), or thorium (Th) to facilitate Ba diffusion and a metal such as calcium (Ca), strontium (Sr), or cerium (Ce) having a different atomic radius from Pt or Pd to change the atomic and electronic structure of the binary alloy.

In addition, the work function of the cathode has been reduced by coating the electron-emitter surface with iridium (Ir) or an alloy of osmium (Os) and ruthenium (Ru) having a larger work function than above quaternary alloy, thereby dropping the operating temperature of the metal cathode.

The metal cathode according to the present invention includes 0.1–20% by weight Ba based on the total weight of the quaternary alloy. If the content of Ba is less than 0.1% by weight, the life span of the resultant metal cathode is shorted due to a shortage of Ba serving as an active component. If the content of Ba exceeds 20% by weight, formation of the emitter becomes difficult with increased brittleness of the alloy ingot, and an undesirable compound with poor electron emission, such as $Pt_2Ba$, is formed on the surface of the metal cathode.

The metal cathode according to the present invention includes 0.1–20% by weight a metallic mobilizer based on the total weight of the quaternary alloy. The metal mobilizer is capable of facilitating the diffusion of Ba in an alloy. As described above, for a Pt—Ba alloy based cathode, Ba exists in the form of $Pt_5Ba$ as an intermetallic compound that is decomposed during operation to provide Ba atoms. Here, the decomposed Ba needs to be diffused fast and continuously toward the emitter surface to lower the work function of the metal cathode.

If the content of metallic mobilizer is less than 0.1% by weight, the diffusion facilitating effect is insignificant. If the content of metallic mobilizer exceeds 20% by weight, the life span and electron emission characteristics of the metal cathode are degraded. It is preferable that the metallic mobilizer facilitating Ba diffusion is at least one of Mo, Hf, Zr, and Th.

The metal cathode according to the present invention includes 0.1–30% by weight a metal based on the total weight of the quaternary alloy with the metal including a difference of 0.4 Å (Angstrom) or greater in atomic radius from the atomic radius of Pt or Pd.

For a conductive or semi-conductive crystal, the work function is defined as the difference between the Fermi level of the crystal and the surface energy at a temperature of absolute zero. A larger work function means that electron emission from the crystal surface is more difficult, and the difficulty in electron emission means that the surface energy state of the crystal is stable (low). In contrast, when the surface energy state of the crystal is unstable (high), electron emission is easier. Addition of a metal having a different atomic radius from Pt or Pd causes a severe distortion in the atomic arrangement of the binary alloy so that the energy state of the alloy is unstablized. This change in the atomic or electronic structure of the alloy lowers the work function.

If the content of the metal with a difference of 0.4 Å (Angstrom) or greater in atomic radius from Pt or Pd is less than 0.01% by weight, the effect of the metal addition is insignificant so that the work function of the metal cathode scarcely changes. If the content of the metal exceeds 30% by weight, the work function increases rather than decreases due to a relative reduction in the amount of the basic emitter source material.

Any metal satisfying the requirement of atomic radius difference, a 0.4 Å (Angstrom) or greater difference in atomic radius from Pt or Pd, can be used without limitation, but at least one of Ca, Sr, and Ce is preferred. In the case where Ce is added, an alloy of Ce with Ir, $Ir_5Ce$, is preferred.

A balance of at least one of Pt and Pd is added to the three metals described above, Ba, a metallic mobilizer, and metal with a predetermined atomic radius difference, so that the metal cathode formed of the quaternary alloy according to the present invention is obtained.

Furthermore, the metal cathode includes a layer of a material having a larger work function than the quaternary alloy coated on the electron-emitter according to the present invention.

When the surface of cathode is coated with a material of high work function, the work function of the metal cathode itself, in other word, the minimum required energy for electron emission becomes lower.

A material of high work function needs more ionized electron donors so that the surface can be optimally covered with Ba. In this manner, coated layer can reduce the work function of the metal cathode. The higher the work function of coating material is, the better the reduction effect is.

A material having a larger work function than the quaternary alloy may be Ir or an Os—Ru alloy, which do not react with Ba. The layer of Ir or Os—Ru alloy coated on the electron-emitter reduces the work function of the metal cathode. In the case where an Os—Ru alloy is used, it is preferable that the alloy contains 1–10% by weight Ru based on the total weight of Os—Ru alloy. If the content of Ru is less than 1% by weight, the effect of adding Ru is insignificant. If the content of Ru exceeds 10% by weight, the effect of reducing the work function is degraded.

It is preferable that the Ir or Os—Ru alloy layer has a thickness of 500–30,000 Å (Angstrom), more preferably, 1,000–10,000 Å (Angstrom). This thickness range is effective in reducing the work function without emission capability degradation.

A method for manufacturing a metal cathode according to the present invention will be described in greater detail through the following example.

First, one of Mo, Hf, Zr, and Th, serving as a metallic mobilizer facilitating Ba diffusion, and one of Ca, Sr, Ce, and Ir—Ce alloy, are placed inside an arc chamber. Because Pt and Ba have a large difference in melting point, it is preferable to use an arc chamber capable of causing spontaneous melting of metals. Ba is liable to vaporize during manufacture of the metal cathode, and thus 1–10% by weight more Ba than the final composition is added. An inert gas such as Ar is supplied into and continuously evacuated from the arc chamber to flush out any reactive residual gasses. Next, the four metals are melted in a moment by the application of a voltage. Due to a great density difference between Pt and Ba, it is difficult to form a uniform metal alloy from these metals. For this reason, in the present invention, melting and solidifying of the alloy are repeated several times, thereby enabling manufacture of a quaternary-alloy metal electrode with uniform chemical composition and fine structure.

The quaternary alloy is cut or molded into a cathode having an appropriate shape for the cathode structure of an electron tube and installed in a cathode assembly.

Alternatively, Ir or Os—Ru alloy may be coated, for example, by evaporation, on the quaternary alloy made in the arc chamber to form a metal cathode according to the present invention. The metal cathode is cut or molded into an appropriate shape for the cathode structure of an electron tube and installed in a cathode assembly.

Figure 3A:
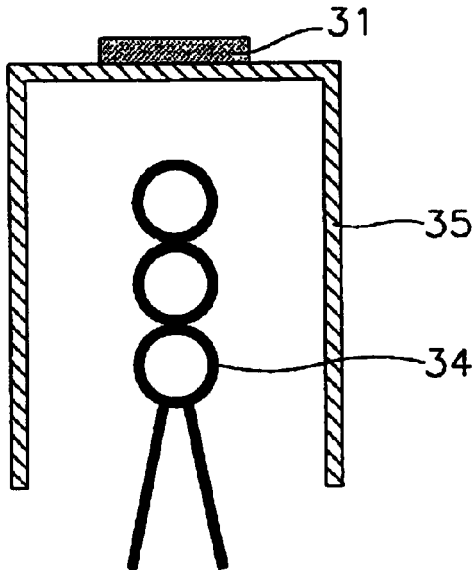
FIGS. 3A and 3B are sectional views of indirectly heated cathode assemblies employing the metal cathode.
Figure 3B:
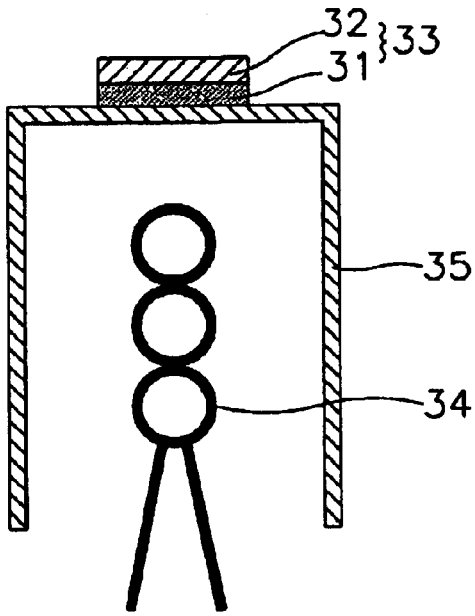

The metal electrode according to the present invention used in an electron tube can be used to form a directed heated cathode assembly, but preferably an indirectly heated cathode assembly, as shown in FIG. 3A or 3B.

Referring to FIG. 3A, a metal cathode 31 according to the present invention, which is formed of the quaternary alloy prepared as described above, is welded to the top of a sleeve 35 in which a heater 34 is installed, to act as a thermoelectron emitter of the indirectly heated cathode assembly. Referring to FIG. 3B, a metal cathode 33 according to the present invention formed by coating an Ir or Os—Ru alloy layer 32 on the quaternary alloy metal cathode 31 prepared as described above, is welded to the top of the sleeve 35 in which the heater 34 is installed, to act as an emitter of the indirectly heated cathode assembly.

The present invention will be described in greater detail by means of the following examples. The following examples are for illustrative purposes and are not intended to limit the scope of the invention.

EXAMPLE 1

3.65 g (grams) of Pt, 0.32 g of Ba, 0.28 g of Mo, and 0.04 g of Ca, each in an ingot form, were placed into an arc chamber. Ar gas was supplied into and continuously evacuated from the arc chamber to flush out any reactive residual gasses. A voltage was applied to the arc chamber to melt the metals, Pt, Ba, Mo, and Ca, and form a quaternary alloy ingot of the metals. The quaternary alloy ingot was subjected to melting three times to enhance uniformity in chemical composition and fine structure. The final quaternary alloy contained, by weight, 85.5% Pt, 7.0% Ba, 6.6% Mo, and 0.7% Ca according to the total weight of the final quaternary alloy.

The quaternary alloy was cut into a metal electrode of an appropriate size and welded to the top of the sleeve 35 as shown in FIG. 3A to form an indirectly heated cathode assembly. Operating temperature and current density variation of the metal cathode were measured. The results are shown in Table 1 and FIG. 2.

EXAMPLE 2

A quaternary alloy including, by weight, 81.0% Pt, 6.9% Ba, 2.6% Hf, and 9.5% $Ir_5Ce$ according to total weight of the quaternary alloy, was prepared in the same manner as in Example 1, except that 3.67 g of Pt, 0.32 g of Ba, 0.12 g of Hf, and 0.43 g of $Ir_5Ce$ were initially used.

The quaternary alloy was cut into a metal electrode of an appropriate size and welded to the top of the sleeve 35 as shown in FIG. 3A to form an indirectly heated cathode assembly. Operating temperature and current density variation of the metal cathode were measured. The results are shown in Table 1 and FIG. 2.

EXAMPLE 3

The quaternary alloy of Example 1 was coated with an Ir layer by vacuum deposition to a thickness of 3,000 Å (Angstrom) and subjected to a thermal process at a temperature of about 1,000° C. (Celsius) in a hydrogen or nitrogen atmosphere.

The quaternary alloy was cut into a metal electrode of an appropriate size and welded to the top of the sleeve 35 as shown in FIG. 3B to form an indirectly heated cathode assembly. Operating temperature and current density variation of the metal cathode were measured. The results are shown in Table 1 and FIG. 2.

EXAMPLE 4

The quaternary alloy of Example 1 was coated with an Os—Ru alloy layer containing 5% by weight Ru according to the total weight of the quaternary alloy by vacuum deposition to a thickness of 1,000 Å (Angstrom) and subjected to a thermal process at a temperature of about 1,000° C. (Celsius) in a hydrogen or nitrogen atmosphere.

The quaternary alloy was cut into a metal electrode of an appropriate size and welded to the top of the sleeve 35 as shown in FIG. 3B to form an indirectly heated cathode assembly. Operating temperature and current density variation of the metal cathode were measured. The results are shown in Table 1 and FIG. 2.

COMPARATIVE EXAMPLE 1

7.29 g of Pt and 0.64 g of Ba, each in an ingot form, were placed in an arc chamber. Ar gas was supplied into and continuously evacuated from the arc chamber to flush out any reactive residual gasses. A voltage was applied to the arc chamber to melt the metals, Pt and Ba, and form a binary alloy ingot of the metals. The binary alloy ingot was subjected to melting three times to enhance uniformity in chemical composition and fine structure. The final binary alloy contained, by weight, 92.2% Pt and 7.8% Ba according to the total weight of the final binary alloy.

The binary alloy was cut into a metal electrode of an appropriate size and welded to the top of the sleeve 35 as shown in FIG. 3A to form an indirectly heated cathode assembly. Operating temperature and current density variation of the metal cathode were measured. The results are shown in Table 1 and FIG. 2.

COMPARATIVE EXAMPLE 2

3.64 g of Pt, 0.32 g of Ba, and 0.04 g of Ca, each in an ingot form, were placed in an arc chamber. Ar gas was supplied into and continuously evacuated from the arc chamber to flush out any reactive residual gasses. A voltage was applied to the arc chamber to melt the metals, Pt, Ba, and Ca, and form a ternary alloy ingot of the metals. The ternary alloy ingot was subjected to melting three times to enhance uniformity in chemical composition and fine structure. The final ternary alloy contained, by weight, 91.0% Pt, 8.0% Ba, and 1.0% Ca according to the total weight of the final ternary alloy.

The ternary alloy was cut into a metal electrode of an appropriate size and welded to the top of the sleeve 35 as shown in FIG. 3A to form an indirectly heated cathode assembly. Operating temperature and current density variation of the metal cathode were measured. The results are shown in Table 1 and FIG. 2.

TABLE 1

| Example | Type of Alloy | Operating temperature, ° C. (Celsius) |
|---|---|---|
| Example 1 | Pt—Ba—Mo—Ca | 1135 |
| Example 2 | Pt—Ba—Hf—$Ir_5Ce$ | 1120 |
| Example 3 | Pt—Ba—Mo—Ca + Ir coating | 1080 |
| Example 4 | Pt—Ba—Hf—$Ir_5Ce$ + Os—Ru coating | 1085 |
| Comparative Example 1 | Pt—Ba | 1220 |
| Comparative Example 2 | Pt—Ba—Ca | 1185 |

Figure 2:
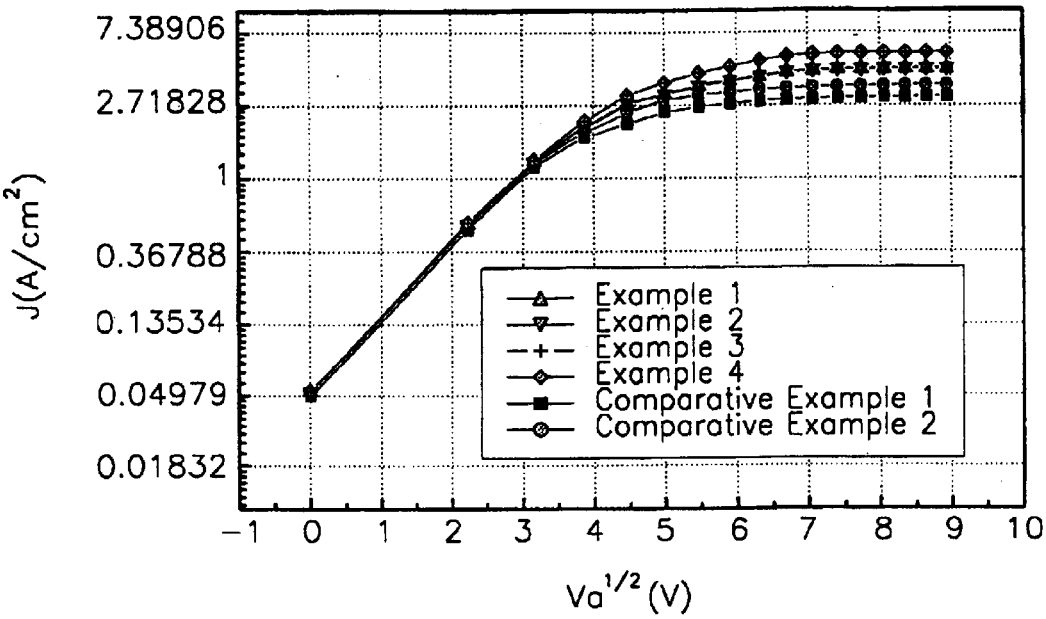
FIG. 2 is a graph showing the electron emission capability of a metal cathode formed of alloys used in examples of the present invention and comparative examples.

As shown in Table 1, the metal cathodes of the respective quaternary alloys according to the present invention formed in Examples 1 through 4, some of which have a coating layer, have an operating temperature of 50–150° C. (Celsius) lower than the conventional metal cathodes formed of the binary and ternary alloys in Comparative Examples 1 and 2. As shown in FIG. 2, the metal cathodes of the present invention show electron emission (evaluated as maximum cathode current (MIK)) improved by 50% or greater, compared to the conventional metal cathodes.

As described above, the metal cathode according to the present invention has a low operating temperature due to its reduced work function with improved current emission capability. The metal cathode according to the present invention can be used for a longer lifetime at high current density. Therefore, the metal cathode according to the present invention can be used effectively in electron-beam devices, such as a Braun tube or picture tube, satisfying larger size, longer life span, high definition, and high luminance requirements of the devices.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A metal cathode for an electron-beam device, the metal cathode comprising an electron-emitter including a first alloy, the first alloy comprising:

barium (Ba) being in the range of 0.1 to 20% by weight based on the total weight of the first alloy;

a metallic mobilizer being in the range of 0.1 to 20% by weight based on the total weight of the first alloy, the metallic mobilizer facilitating Ba diffusion, the metallic mobilizer being at least one selected from the group consisting essentially of molybdenum (Mo), hafnium (Hf), zirconium (Zr), and thorium (Th);

a metal with a difference in atomic radius of at least 0.4 Angstrom from the atomic radius of any one of platinum (Pt) and palladium (Pd), the metal being in the range of 0.01 to 30% by weight based on the total weight of the first alloy; and at least one element selected from the group consisting essentially of platinum (Pt) and palladium (Pd).

2. The metal cathode of claim 1, wherein the metal is at least one member selected from the group consisting essentially of calcium (Ca), strontium (Sr), and cerium (Ce).

3. The metal cathode of claim 1, wherein the metal is an alloy of cerium (Ce) and iridium (Ir).

4. The metal cathode of claim 3, wherein the alloy of Ce and Ir is $Ir_5Ce$.

5. A cathode assembly comprising the metal cathode of claim 4, the cathode assembly being indirectly heated.

6. A cathode assembly comprising the metal cathode of claim 1, the cathode assembly being indirectly heated.

7. A metal cathode for an electron-beam device, comprising:

an electron-emitter formed of a first alloy comprising:

barium (Ba) being in the range of 0.1 to 20% by weight based on the total weight of the first alloy;

a metallic mobilizer facilitating Ba diffusion being in the range of 0.1 to 20% by weight based on the total weight of the first alloy, the metallic mobilizer being at least one member selected from the group consisting essentially of molybdenum (Mo), hafnium (Hf), zirconium (Zr), and thorium (Th);

a metal with a difference in atomic radius of at least 0.4 Angstrom from the atomic radius of any one of platinum (Pt) and palladium (Pd), the metal being in the range of 0.01 to 30% by weight based on the total weight of the first alloy; and at least one element selected from the group consisting essentially of platinum (Pt) and palladium (Pd); and a layer coated on the electron-emitter, the layer being at least one member consisting essentially of iridium (Ir) and an alloy of osmium (Os) and ruthenium (Ru).

8. The metal cathode of claim 7, wherein the metal is at least one member selected from the group consisting essentially of calcium (Ca), strontium (Sr), and cerium (Ce).

9. The metal cathode of claim 7, wherein the metal is an alloy of cerium (Ce) and iridium (Ir).

10. The metal cathode of claim 9, wherein the alloy of Ce and Ir is $Ir_5Ce$.

11. The metal cathode of claim 7, wherein the layer coated on the electron-emitter has a thickness in the range of 500 to 30,000 Angstroms.

12. The metal cathode of claim 7, wherein the layer coated on the electron-emitter has a thickness in the range of 1,000 to 10,000 Angstroms.

13. The metal cathode of claim 11, wherein the alloy of Os and Ru includes Ru in the range of 1 to 10% by weight based on the total weight of the alloy of Os and Ru.

14. A cathode assembly comprising the metal cathode of claim 7, the cathode assembly being indirectly heated.

15. A cathode assembly comprising the metal cathode of claim 11, the cathode assembly being indirectly heated.

16. A metal cathode for an electron-beam device, the metal cathode comprising:

an electron-emitter consisting essentially of:

barium (Ba) being in the range of 0.1 to 20% by weight based on the total weight of the electron-emitter;

a metallic mobilizer being in the range of 0.1 to 20% by weight based on the total weight of the electron-emitter, the metallic mobilizer facilitating Ba diffusion, the metallic mobilizer being at least one member selected from the group consisting essentially of molybdenum (Mo), hafnium (Hf), zirconium (Zr), and thorium (Th);

a metal with a difference in atomic radius of at least 0.4 Angstrom from the atomic radius of any one of platinum (Pt) and palladium (Pd), the metal being in the range of 0.01 to 30% by weight based on the total weight of the electron-emitter; and a balance of at least one of platinum (Pt) and palladium (Pd).

17. The metal cathode of claim 16, further comprising a layer coated on the electron-emitter, the layer being at least one member consisting essentially of iridium (Ir) and an alloy of osmium (Os) and ruthenium (Ru).

18. A cathode assembly comprising the metal cathode of claim 17, the cathode assembly being indirectly heated.

19. A cathode assembly comprising the metal cathode of claim 16, the cathode assembly being indirectly heated.

* * * * *